US008826826B2

(12) United States Patent
Weiner

(10) Patent No.: US 8,826,826 B2
(45) Date of Patent: Sep. 9, 2014

(54) METHOD OF PROVIDING TRANSPORTATION SYSTEMS, AND METHOD OF PROVIDING VISUAL IMAGES FOR SUCH SYSTEMS

(76) Inventor: Irving M. Weiner, Harrisville, MI (US)

( * ) Notice: Subject to any disclaimer, the term of this patent is extended or adjusted under 35 U.S.C. 154(b) by 209 days.

(21) Appl. No.: 13/290,073

(22) Filed: Nov. 5, 2011

(65) Prior Publication Data

US 2012/0132102 A1 May 31, 2012

Related U.S. Application Data

(60) Provisional application No. 61/410,910, filed on Nov. 7, 2010.

(51) Int. Cl.

| | |
|---|---|
| ***B61B 13/10*** | (2006.01) |
| ***B61L 25/02*** | (2006.01) |
| ***B61L 15/00*** | (2006.01) |

(52) U.S. Cl.

CPC ..... *B61B 13/10* (2013.01); *B61L 25/025* (2013.01); *B61L 2210/04* (2013.01); *B61L 15/009* (2013.01)

USPC ..... 104/138.1; 348/148

(58) Field of Classification Search

USPC ..... 104/138.1; 348/837

See application file for complete search history.

(56) References Cited

U.S. PATENT DOCUMENTS

| | | | | |
|---|---|---|---|---|
| 4,512,258 | A | 4/1985 | Matsukata | |
| 2005/0166785 | A1 * | 8/2005 | Schramek et al. | 104/91 |
| 2007/0272115 | A1 * | 11/2007 | Mayer et al. | 104/20 |
| 2008/0143892 | A1 * | 6/2008 | Lytell | 348/837 |
| 2009/0101040 | A1 * | 4/2009 | Yang | 104/138.1 |
| 2009/0284598 | A1 * | 11/2009 | Busch et al. | 348/148 |
| 2012/0132102 | A1 * | 5/2012 | Weiner | 104/138.1 |

FOREIGN PATENT DOCUMENTS

| | | | | |
|---|---|---|---|---|
| GB | 2332083 A * | 6/1999 | | G09F 19/22 |

* cited by examiner

*Primary Examiner* — Jason C Smith

(74) *Attorney, Agent, or Firm* — Weiner & Burt, P.C.; Irving M. Weiner; Pamela S. Burt

(57) ABSTRACT

A method of providing a weather-proof high-speed transportation system including an underground tunnel tube within which a high-speed vehicle moves. Presenting visual images to a person on the vehicle in coordination with the instantaneous location of the person. Providing visual images with or without accompanying audio to a person on the vehicle including correlating the visual images to a predetermined location of the person.

19 Claims, No Drawings

METHOD OF PROVIDING TRANSPORTATION SYSTEMS, AND METHOD OF PROVIDING VISUAL IMAGES FOR SUCH SYSTEMS

CROSS-REFERENCE TO RELATED APPLICATIONS

The present application is a continuation-in-part of and claims priority from U.S. Provisional Patent Application Ser. No. 61/410,910 filed Nov. 7, 2010.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING COMPACT DISC APPENDIX

Not Applicable.

BACKGROUND OF THE INVENTION

The present invention relates to a method of providing transportation systems, and to a method of providing visual images to such systems.

More particularly, the present invention relates: to a method of providing a weather-proof high-speed transportation system including an underground tunnel tube within which a high-speed vehicle may move, and selectively presenting visual images to a person on the vehicle in coordination with the instantaneous location of the person along the route of the vehicle; and to a method of providing visual images with or without accompanying audio to a person on a vehicle including correlating the visual images to a predetermined location of the person.

Conventional aviation and surface transportation systems are unreliable and subject to weather conditions.

Also, such conventional systems causes significant environmental damage to the atmosphere, plants, humans and animals.

Furthermore, billions of dollars are spent each year to deal with damage, destruction, delays, etc. of transportation systems, electric power systems, gas lines, and other infrastructure systems caused by snow, rain, high wind, storms, hurricanes, tornadoes, and other climatic conditions. It would be advantageous to have transportation systems that avoid these adverse effects.

Also, when overland, sea, and/or airborne traffic systems are damaged by ICBM attack, an underground back-up system can be deployed so that economic, governmental and military activities can be maintained.

Furthermore, passengers on conventional vehicles see little or nothing via windows during adverse ambient conditions, e.g., tunnel walls, nighttime, inclement weather, reflections, military attacks, insufficient light, etc.

Similarly, tourists on such vehicles see and/or hear little or nothing about the geography, history, and/or present conditions of the route being traversed.

It is a desideratum of the present invention to avoid the animadversions of conventional systems, and to provide novel transportation systems, and a method of providing visual images to such systems.

SUMMARY OF THE INVENTION

The invention provides a method of providing visual images with or without accompanying audio to a person on a vehicle, comprising the steps of: preparing visual images of what a person on the vehicle would see from a window of the vehicle on a perfectly clear, calm, sunny day while traveling on the vehicle with or without accompanying audio; correlating said visual images with or without accompanying audio to predetermined locations along a route of the vehicle; and selectively presenting said visual images with or without accompanying audio to the person on the vehicle in coordination with the instantaneous location of the person traveling along said route.

The invention also provides such a method including the steps of: moving the vehicle on the ground, underground, on water, underwater, or airborne; and preparing said visual images of what the person on the vehicle would see from a window of the vehicle on a perfectly clear, calm, sunny day as if the vehicle was traveling on the ground, on the water, or airborne, respectively, with or without accompanying audio.

The invention also provides a method of providing a weather-proof high-speed transportation system, comprising the steps of: providing a high-speed vehicle; providing an underground tunnel tube within which the high-speed vehicle may move; moving the high-speed vehicle in said underground tunnel tube; preparing visual images of what a person on the vehicle would see from a window of the vehicle on a perfectly clear, calm, sunny day while traveling on the vehicle along a route on the ground directly above said underground tunnel tube with or without accompanying audio; correlating said visual images with or without accompanying audio to predetermined locations along said route; and selectively presenting said visual images with or without accompanying audio to the person on the vehicle in coordination with the instantaneous location of the person traveling along said route.

An object of the invention is to provide such a method including the step of: providing said underground tunnel tube with one or more of a group consisting of: oil, water, and gas pipelines; channels for laser and microwave waveguides; electric power lines including superconducting ones; and freight systems.

Another object of the invention is to provide such a method including the steps of: boarding and letting off persons efficiently to and from the vehicle so that the vehicle does not have to stop at all stations along said route.

Another object of the invention is to provide such a method including the step of: providing a high-speed vehicle system with two-tier tracks.

Another object of the invention is to provide such a method including the step of: propelling the vehicle within a partial vacuum in said underground tunnel tube.

Another object of the invention is to provide such a method including the step of: propelling the vehicle cradled in at least one magnetic field whereby the vehicle travels through a partial or complete vacuum.

Another object of the invention is to provide such a method including the step of: propelling the vehicle at high-speed on a maglev line through an evacuated (air-less) or partly evacuated underground tunnel tube.

Another object of the invention is to provide such a method including the step of: selectively displaying said visual images on a window of the vehicle.

Another object of the invention is to provide such a method including the step of: selectively displaying said visual images on a screen in the vehicle.

Another object of the invention is to provide such a method including the step of: selectively presenting said visual images with or without accompanying audio to the person on said vehicle in coordination with the instantaneous location of the person along said route in such a manner that said visual images correspond to what the person would have been able see at a predetermined date in history on a perfectly clear, calm, sunny day.

Another object of the invention is to provide such a method including the step of selectively presenting said visual images with accompanying audio to the person on said vehicle in coordination with the instantaneous location of the person along said route in such a manner that said accompanying audio describes at least portions of said visual images.

Another object of the invention is to provide such a method including the step of selectively presenting said visual images with accompanying audio to the person on said vehicle in coordination with the instantaneous location of the person along said route in such a manner that said accompanying audio describes at least portions of said visual images with or without geographical and/or historical commentary.

Another object of the invention is to provide such a method including the step of selectively presenting said visual images with accompanying audio to the person on said vehicle in coordination with the instantaneous location of the person along said route in such a manner that said accompanying audio describes at least portions of said visual images.

It is a primary object of the present invention to provide the method as described above including the step of confining the vehicle to move underground at all times.

Another object of the present invention is to provide the methods as described above including the step of selectively presenting said predetermined visual images with or without accompanying audio to a person on said vehicle in coordination with the instantaneous location of the person on said vehicle in such a manner that said predetermined visual images correspond to what the person would be able see on a perfectly clear and sunny day from a vehicle traveling on the ground directly above said instantaneous location.

A further object of the present invention is to provide the methods as described above, including the step of moving the vehicle at a high rate speed utilizing maglev.

Yet another object of the present invention is to provide the methods as described above, including the steps of boarding and letting off persons efficiently to and from the vehicle so that the vehicle does not have to stop at all stations.

Yet another object of the present invention is to provide the methods as described above, including the step of providing a high-speed vehicle system with two-tier tracks.

A further object of the present invention is to provide the methods as described above, including the step of propelling the vehicle in an underground tunnel under a partial vacuum.

Yet another object of the present invention is to provide the methods as described above, including the step of providing a tunnel system shared by one or more of a group consisting of: oil, water, and gas pipelines; channels for laser and microwave waveguides; electric power lines including superconducting ones; and freight systems.

A further object of the present invention is to provide the methods as described above, including the step of selectively displaying said predetermined visual images on a window of the vehicle.

Yet another object of the present invention is to provide the methods as described above, including the step of selectively displaying said predetermined visual images on a screen in the vehicle.

Other objects, advantages, and features of the present invention will become apparent to those persons skilled in this particular area of technology and to other persons after having been exposed to the present patent application.

DETAILED DESCRIPTION OF THE INVENTION

A first aspect of the invention relates to a method of providing visual images with or without accompanying audio to a person on a vehicle, comprising the steps of: preparing visual images of what a person on the vehicle would see from a window of the vehicle on a perfectly clear, calm, sunny day while traveling on the vehicle with or without accompanying audio; correlating said visual images with or without accompanying audio to predetermined locations along a route of the vehicle; and selectively presenting said visual images with or without accompanying audio to the person on the vehicle in coordination with the instantaneous location of the person traveling along said route.

The method also includes the steps of: moving the vehicle on the ground, underground, on water, underwater, or airborne; and preparing said visual images of what the person on the vehicle would see from a window of the vehicle on a perfectly clear, calm, sunny day as if the vehicle was traveling on the ground, on the water, or airborne, respectively, with or without accompanying audio.

Furthermore, when an overland, airborne, and/or oversea transit system is impaired by weather conditions or is damaged or destroyed by missile attack or other type of attack, an underground back-up system could be deployed so that the economic activities of a country could be maintained.

A second aspect of the invention relates to a method of providing a weather-proof, missile-proof, radiation-proof, high-speed transportation system, and method of providing visual images to the system also achieves multiple advantages under non-military conditions as well.

In particular, the second aspect relates to a method of providing a weather-proof high-speed transportation system, comprising the steps of: providing a high-speed vehicle; providing an underground tunnel tube within which the high-speed vehicle may move; moving the high-speed vehicle in said underground tunnel tube; preparing visual images of what a person on the vehicle would see from a window of the vehicle on a perfectly clear, calm, sunny day while traveling on the vehicle along a route on the ground directly above said underground tunnel tube with or without accompanying audio; correlating said visual images with or without accompanying audio to predetermined locations along said route; and selectively presenting said visual images with or without accompanying audio to the person on the vehicle in coordination with the instantaneous location of the person traveling along said route.

One possible embodiment of the invention comprises method of providing a weather-proof high-speed transportation system, including the steps of providing a high-speed vehicle, such as a maglev train; and providing an underground tunnel or tube within which the high-speed vehicle may move.

The underground tunnel is constructed at a sufficient depth to make it weather-proof, missile-proof, and radiation proof.

During construction of the tunnels, there will be the added advantage of discovering geological, archeological, and/or biblical objects.

Also, during times of military attack or threats thereof, the tunnels and the trains therein can be used as the temporary seat of government and/or to protect people, e.g., government and military personnel, tourists, et al.

Implementation of the invention will also increase employment and greatly foster tourism.

Passengers on conventional vehicles see little or nothing via windows during adverse ambient conditions, e.g., tunnel walls, nighttime, inclement weather, reflections, military attacks, insufficient light, etc.

Similarly, tourists on such vehicles see and/or hear little or nothing about the geography, history, and/or present conditions of route being traversed.

The present invention avoids the above-mentioned disadvantages of conventional systems and vehicles.

After the tunnel route has been finalized or completed, there is prepared a motion picture (with or without audio) on a perfectly clear and sunny day of the scenery which a passenger would see riding on a train on the ground surface directly above a similarly-located passenger riding on a train in the tunnel.

The passenger on the tunnel train may, if desired, activate (or de-activate) a device that would display the motion picture on a passenger's window or an appropriate screen or display for the passenger to view.

The motion picture would be displayed to the passenger in exact moving synchronism as if the passenger were riding on a train on the ground surface directly above a similarly-located passenger riding on a train in the tunnel.

The tunnel train passenger may also, if desired, activate (or de-activate) a device to add audio to the motion picture.

Such audio may include one or more trajectory-synchronized audio presentations relating to: biblical or non-biblical geography; biblical or non-biblical history; present conditions of the route being traversed; adjacent industries, agriculture, geology, or sight-seeing; politics; etc.

Public address announcements can override, if necessary, any such trajectory-synchronized audio presentations.

The invention also embraces the concept of modifying, if necessary, the presentation of the motion picture to correlate to the instantaneous speed of the high-speed train.

The present invention also provides the step of producing predetermined visual images, e.g., a motion picture) with or without accompanying audio which corresponds to what an above-ground passenger would have been able see at a predetermined date in history on a perfectly clear and sunny day from a vehicle traveling above ground.

The present invention also provides the further step of selectively presenting said predetermined visual images with or without accompanying audio to a person on said vehicle in coordination with the instantaneous location of the person on said vehicle in such a manner that said predetermined visual images correspond to what the person would have been able see at a predetermined date in history on a perfectly clear and sunny day from a vehicle traveling above ground of said instantaneous location.

The present invention further provides the methods as described herein, including the steps of boarding and letting off persons efficiently to and from the vehicle so that the vehicle does not have to stop at stations. Examples of doing so are disclosed in Mayer et al. United States Patent Application Publication No. US 2007/0272115, the entire contents of which are incorporated herein by reference thereto.

The present invention further provides the methods as described herein, including the step of providing a high-speed vehicle system with two-tier tracks. Examples of doing so are disclosed in Schramek et al. United States Patent Application Publication No. US 2005/0166785, the entire contents of which are incorporated herein by reference thereto.

The present invention further provides the methods as described herein, including the step of propelling the vehicle in an underground tunnel under a partial vacuum. This entails constructing, for example, maglev lines through evacuated (air-less) or partly evacuated tubes or tunnels.

The present invention is not limited to high-speed vehicles, nor to underground transportation systems.

One aspect of the invention entails a method of providing visual images with or without accompanying audio to a person on a vehicle, comprising the steps of: preparing visual images with or without accompanying audio; correlating predetermined visual images with or without accompanying audio to a predetermined location; and selectively presenting said predetermined visual images with or without accompanying audio to a person on said vehicle in coordination with the instantaneous location of the person on said vehicle.

Furthermore, billions of dollars are spent each year to deal with damage, destruction, delays, etc. of transportation systems, electric power systems, gas lines, and other infrastructure systems caused by snow, rain, high wind, storms, hurricanes, tornadoes, and other climatic conditions. It would be advantageous to have transportation systems that avoid these adverse effects.

Thus, the present invention also provides methods as described herein, wherein the tunnel systems would be shared by: oil, water, and gas pipelines; channels for laser and microwave waveguides; electric power lines including superconducting ones; and freight systems.

There has described hereinabove only several possible unique and novel embodiments of the present invention which can be practiced and constructed in many different embodiments, configurations, materials, arrangements of components, sizes, and shapes.

It should be understood that many changes, modifications, variations, and other uses and applications will become apparent to those persons skilled in this particular area of technology and to others after having been exposed to the present patent specification.

Any and all such changes, modifications, variations and other uses and applications which do not depart from the spirit and scope of the present invention are therefore covered by and embraced within the present invention and the patent claims set forth hereinbelow.

The invention claimed is:

1. A method of providing visual images with or without accompanying audio to a passenger on a vehicle, comprising the steps of: after determining a route of the the vehicle, preparing a motion picture of visual images of scenery along said route which a passenger on the vehicle would see from a window of the vehicle on a substantially clear, calm, sunny day while traveling in the vehicle on the ground surface along said route of the vehicle; said visual images are correlated with images of what said passenger would see from the window at the instantaneous geographical locations of the passenger traveling along said route of the vehicle; providing a device for a passenger to selectively activate or de-activate which device would selectively display said visual images of said motion picture of said scenery for the passenger to view; and selectively presenting said visual images of said motion picture of said scenery with or without accompanying audio to the passenger in exact moving synchronism as if the passenger were traveling on the vehicle on the ground surface viewing said scenery on a substantially clear, calm, sunny day in coordination with the instantaneous location of the passenger traveling along said route.

2. The method of claim 1, including the steps of: moving the vehicle on the ground, underground, on water, underwater, or airborne; and preparing said visual images of said motion picture of said scenery which the passenger on the vehicle would see from a window of the vehicle on a substantially clear, calm, sunny day as if the vehicle was traveling on the ground, on the water, or airborne, respectively, with or without accompanying audio.

3. The method of claim 1, including the step of: selectively displaying said visual images of said motion picture on the passenger's window of the vehicle.

4. The method of claim 1, including the step of: propelling the vehicle in an underground tunnel under a partial vacuum.

5. The method of claim 1, including the step of: propelling the vehicle at high-speed on a maglev line through an evacuated (air-less) or partly evacuated tunnel tube.

6. The method of claim 1, including the step of: moving the vehicle in a tunnel system shared by one or more of a group consisting of: oil, water, and gas pipelines; channels for laser and microwave waveguides; electric power lines including superconducting ones; and freight systems.

7. The method of claim 1, including the step of: selectively presenting said visual images of said motion picture on a screen in the vehicle for said passenger.

8. A method of providing a weather-proof high-speed transportation system, comprising the steps of: providing a high-speed vehicle; providing an underground tunnel tube within which the high-speed vehicle may move; moving the high-speed vehicle in said underground tunnel tube; after determining a route of the vehicle, preparing motion picture of visual images of scenery along said route which a passenger on the vehicle would see from a window of the vehicle on a substantially clear, calm, sunny day while traveling on the vehicle along the ground surface along said route of the vehicle said visual images are correlated with images of what said passenger would see from the window at the instantaneous geographical locations of the passenger traveling along said route of the vehicle; providing a device for a passenger selectively activate or de-activate which device would selectively display said visual images of said motion picture of said scenery on the passenger's window or a passenger's screen or a passenger's display for the passenger to view; and selectively presenting said visual images of said motion picture of said scenery to the passenger in exact moving synchronism as if the passenger where traveling on the vehicle on the ground surface directly above the similarly-located passenger riding on said high-speed vehicle in said underground tunnel tube.

9. The method of claim 8, including the step of: providing said underground tunnel tube with one or more of a group consisting of: oil, water, and gas pipelines; channels for laser and microwave waveguides; electric power lines including superconducting ones; and freight systems.

10. the method of claim 8, including the steps of: boarding and letting off passengers efficiently to and from said high-speed vehicle so that said high-speed vehicle does not have to stop at all of the stations along said route.

11. The method of claim 8, including the steps of: propelling the vehicle within a partial vacuum in said underground tunnel tube.

12. The method of claim 8, including the step of: propelling the vehicle cradled in at least one magnetic field whereby the vehicle travels through a partial or complete vacuum.

13. The method of claim 8, including the step of: propelling the vehicle at high-speed on a maglev line through an evacuated (air-less) or partly evacuated underground tunnel tube.

14. The method of claim 8, including the step of: selectively displaying said visual images of said motion picture of said scenery on said passenger's window of said high-speed vehicle.

15. The method of claim 14, including the step of: selectively presenting said motion picture of visual images with accompanying audio to the passenger on said vehicle in coordination with the instantaneous location of the person along said route in such a manner that said accompanying audio describes at least portions of said visual images of said motion picture.

16. The method of claim 8, including the step of: selectively displaying said visual images of said motion picture of said scenery on said passenger's screen in said high-speed vehicle.

17. The method of claim 8, including the step of: after determining a route of said underground tunnel tube, preparing a motion picture of visual images with or without accompanying audio which corresponds to what an above-ground passenger would have been able to see on a predetermined date in history on a substantially clear, calm, sunny day while traveling on said high-speed vehicle on the ground surface above said underground tunnel tube; and selectively presenting said motion picture of said visual images with or without accompanying audio to the passenger on said vehicle in coordination with the instantaneous location of the passenger would have been able see on said predetermined date in history on a substantially clear, clam, sunny day.

18. The method of claim 8, including the step of: selectively presenting said motion picture of said visual images with accompanying audio to the passenger on said vehicle in coordination with the instantaneous location of the passenger along said route in such a manner that said accompanying audio describes at least portions of said motion picture of said visual images.

19. The method of claim 8, including the step of: selectively presenting said motion picture of said visual images with accompanying audio to the passenger on said vehicle in coordination with the instantaneous location of the person along said route in such a manner that said accompanying audio describes at least portions of said motion picture visual images with or without geographical and/or historical commentary.

* * * * *